US005469827A

United States Patent [19]

Tomisawa

[11] Patent Number: 5,469,827

[45] Date of Patent: Nov. 28, 1995

[54] METHOD AND APPARATUS FOR CONTROL OF THE START-UP AIR-FUEL RATIO OF AN INTERNAL COMBUSTION ENGINE

[75] Inventor: Naoki Tomisawa, Atsugi, Japan

[73] Assignee: Unisia Jecs Corporation, Atsugi, Japan

[21] Appl. No.: 189,745

[22] Filed: Feb. 1, 1994

[30] Foreign Application Priority Data

Feb. 2, 1993 [JP] Japan ..... 5-015666

[51] Int. Cl.[6] ..... F02M 51/00

[52] U.S. Cl. ..... 123/491

[58] Field of Search ..... 123/491, 486, 123/421, 179.1, 179.16, 575, 179.3; 364/431.1

[56] References Cited

U.S. PATENT DOCUMENTS

| | | | |
|---|---|---|---|
| 5,188,082 | 2/1993 | Udo et al. | 123/491 |
| 5,199,394 | 4/1993 | Hartmann et al. | 123/491 |
| 5,215,062 | 6/1993 | Asano et al. | 123/491 |
| 5,224,456 | 7/1993 | Hosoda et al. | 123/491 |
| 5,289,808 | 3/1994 | Takahashi et al. | 123/491 |
| 5,365,917 | 11/1994 | Adams et al. | 123/491 |

*Primary Examiner*—Raymond A. Nelli
*Attorney, Agent, or Firm*—Foley & Lardner

[57] ABSTRACT

The air/fuel ratio of an intake mixture of an internal combustion engine becomes excessively rich due to fuel leaked from the fuel injection valve into the intake system during a period from shut-down until restart. To overcome the resultant poor starting, the amount of leakage is estimated based on the engine temperature at shut down, and an elapsed time from shut-down until restart which is determined for example based on a difference between the engine shut-down temperature and the engine temperature at restart. The start-up fuel injection amount or the start-up intake flow rate is then corrected corresponding to this leakage amount.

As a result, since a suitable start-up air/fuel ratio can be obtained in spite of fuel leakage from the fuel injection valve into the intake system, good engine starting can be ensured.

22 Claims, 16 Drawing Sheets

METHOD AND APPARATUS FOR CONTROL OF THE START-UP AIR-FUEL RATIO OF AN INTERNAL COMBUSTION ENGINE

FIELD OF THE INVENTION

The present invention relates to a method and apparatus for control of the start-up air/fuel ratio of an internal combustion engine used for vehicular, marine or stationary applications. In particular the invention relates to a method and apparatus for control of the start-up air/fuel ratio of an internal combustion engine in which fuel is supplied by a fuel injection valve.

DESCRIPTION OF THE RELATED ART

Conventionally, with internal combustion engines, the fuel injection amount at start-up is corrected with an additional amount to that for normal operation to increase the mixture strength and thus improve engine starting.

In particular, with engines using electronically controlled fuel injection systems, the start-up fuel injection amount is determined as follows:

For example, once a start signal is received from the key switch at the time of cranking, a start-up fuel injection pulse width $CSP_{1LN}$ signal obtained by the following equation is sent to the fuel injection valve to drive the fuel injection valve open by an amount corresponding to the signal so that fuel is injected in a predetermined amount into the intake manifold.

$$CSP_{1LN}=CSP_{1LNTWK}\times K_{LN}\times K_{LT}$$

where; $CSP_{1LN}$ is the start-up fuel injection pulse width, $CSP_{1LNTWK}$ is the start-up basic fuel injection pulse width, $K_{LN}$ is a rotational speed correction coefficient, and $K_{LT}$ is a time correction coefficient.

The start-up basic fuel injection pulse width $CSP_{1LNTWK}$ is a previously set and stored fuel injection pulse width corresponding to the engine temperature, the rotational speed correction coefficient $K_{LN}$ is a previously set and stored variable corresponding to the cranking rotational speed, and the $K_{LT}$ is a previously set and stored variable corresponding to the cranking time.

In this case the start-up fuel injection pulse width $CSP_{1LN}$ reduces with elapsed time, and after a predetermined elapsed time becomes the fuel injection pulse width $CSP_1$ for normal operation.

With the above mentioned electronically controlled fuel injection system of an internal combustion engine wherein fuel is supplied to the intake manifold with a fuel injection valve, restarting after the engine has been stopped for a relatively short time, can be difficult. In this case starting can be difficult even when the engine has warmed up which is normally considered a relatively good starting condition. Clarification of the cause of this poor starting is thus necessary so as to take steps to resolve the unsatisfactory condition.

In view of this, the present inventor carried out various tests, and ascertained that the poor starting after engine warm up is produced by the following causes.

During engine operation, since the fuel injection valve is warmed up to a relatively high temperature by the heat of combustion, it remains at a high temperature for quite a long time even after the engine has stopped. As a result, the various components of the fuel injection valve undergo slight thermal deformation. Particularly with the internal valve seat of the fuel injection valve which is precision machined to prevent fuel leakage, the fuel sealing ability is very susceptible to the influence of even a slight thermal deformation.

In addition, after engine shut-down, the fuel left inside the fuel injection valve also remains, in a similar manner, at a high temperature, resulting in a lower density (lower viscosity). This calls for even more stringent conditions to counteract fuel leakage from the valve seat.

These sensitive causes related to the fuel leakage from the valve seat of the fuel injection valve all add up to cause fuel leakage from the fuel injection valve even after engine shut-down. A part of this leaked fuel vaporizes in the intake manifold which is heated by heat from the engine, resulting in an excessively rich (saturated) mixture in the vicinity of the intake port, while the remainder forms on the inner wall of the intake manifold. As shown in FIG. 9, the total amount of fuel leakage becomes greater the higher the engine temperature and the longer the period of shut down.

If restart is carried out under these conditions, the mixture introduced to the engine combustion chamber, which is basically a rich mixture due to the normal start-up increase amount, is further enriched by the addition of the extremely rich mixture of leaked fuel vaporized in the intake manifold. Consequently, as shown in FIG. 10, the air/fuel ratio can exceed the rich start limits making it difficult to start the engine. In particular, when starting with an engine temperature above normal (25° C.), that is to say under conditions which promote vaporization of the fuel leaked into the intake manifold, poor starting becomes very evident due to the increased rate of vaporization.

SUMMARY OF THE INVENTION

In view of the above situation, an object of the present invention is to ensure there is no deterioration in starting of an internal combustion engine even with fuel leakage from the seat of the fuel injection valve during the period from engine shut-down until the next start-up (restart). Moreover, it is an object to be able to achieve this with a simple construction and at low cost.

In order to achieve the above objectives, the method and apparatus according to the present invention for control of the start-up air/fuel ratio of an internal combustion engine, involves estimating an amount of fuel leaked from the fuel injection valve into the intake system of the engine during the period from engine shut-down until restart, and correcting the start-up fuel injection amount or intake flow rate, on the basis of the estimated fuel leakage amount.

With such a construction, even with fuel leakage from the fuel injection valve into the engine intake system during the period from engine shut-down until restart, since the start-up fuel injection amount increase corrected by the conventional method or the intake flow rate can be corrected at the time of restart to correspond to the fuel leakage amount, then a mixture adjusted to give an air/fuel ratio suitable for restart can be supplied to the engine. Accordingly, engine starting can be improved and worsening of exhaust composition due to poor starting prevented. Moreover, with such a construction, good starting can be achieved with machining tolerances for the valve seat components of the fuel injection valve which are already high, maintained at their present level. Consequently, the significant increase in costs for components and processing which accompany higher tolerances aimed at zero fuel leakage, can be avoided.

The correction of the intake flow rate is an effective technique for conditions where over richness cannot be avoided by simply correcting the fuel injection amount. For example in the case of considerable fuel leakage, or when the leaking fuel is easily vaporized, and the over richness cannot be avoided even by shutting off the start-up fuel injection from the fuel injection valve.

Estimation of the fuel leakage amount involves storing/retaining the engine temperature at engine shut-down, and estimating or detecting the elapsed time from engine shut-down until restart. The leakage amount can then be estimated based on the engine temperature at the previous shut-down, and the elapsed time from the previous shut down until restart. This is because, as shown in FIG. 7, the fuel leakage amount is determined by the engine temperature at shut-down, and the elapsed time from the previous shut-down until restart. Accordingly, the fuel leakage amount can be easily estimated using a simple and low cost construction.

The elapsed time from the engine shut-down until restart can be detected using a timer which is started by an OFF signal and stopped by an ON signal of a key switch. Hence, an accurate elapsed time can be detected.

Furthermore, the elapsed time from the engine shut-down until restart can be estimated on the basis of the engine shut-down temperature and the engine temperature at restart. In this case, since the before-mentioned timer is no longer necessary, battery power consumption when the engine is stopped can be eliminated and equipment construction simplified.

The before-mentioned correction of the intake flow rate at start-up can be carried out by forcibly adjusting the opening of the intake throttle valve connected to an accelerator pedal and provided in the engine intake system, using a device such as an actuator. Hence, correction of the intake flow rate can be achieved using a comparatively simple construction.

Furthermore, with an internal combustion engine provided with an intake control valve interposed in an intake by-pass passage which by-passes the intake throttle valve, the before-mentioned correction of the intake flow rate at start-up can be carried out by adjustment of the opening of the intake control valve. With such an engine, it is not necessary to provide a separate new device to correct the intake flow rate at start-up. Therefore, improved starting can be achieved with a minimum increase in manufacturing and product costs. Needless to say a new intake control valve can be provided, instead of carrying out the before-mentioned forcibly adjustment on the intake throttle valve.

Here the amount of fuel leaked from the fuel injection valve into the intake system of the engine during the period from engine shut-down until restart can be estimated, and the start-up fuel injection amount and intake flow rate corrected on the basis of the estimated fuel leakage amount. Therefore, the situation wherein the air/fuel ratio is adjusted to an optimum amount using only intake flow rate correction but the fuel amount supplied to the engine is still large compared to that for normal start-up, can be avoided by simultaneous reduction correction of the fuel injection amount. The arrangement can thus be used with vehicles and the like fitted with automatic transmissions which can have problems with sudden take-off due to the increased rotational speed at start-up.

Other objects and aspects of the present invention will become apparent from the following description of the preferred embodiments taken in conjunction with the appended drawings.

DETAILED DESCRIPTION OF THE PREFERRED EMBODIMENTS

Embodiments of the method and apparatus for control of the start-up air/fuel ratio of an internal combustion engine according to the present invention are illustrated in FIG. 3 through FIG. 15.

Figure 1:
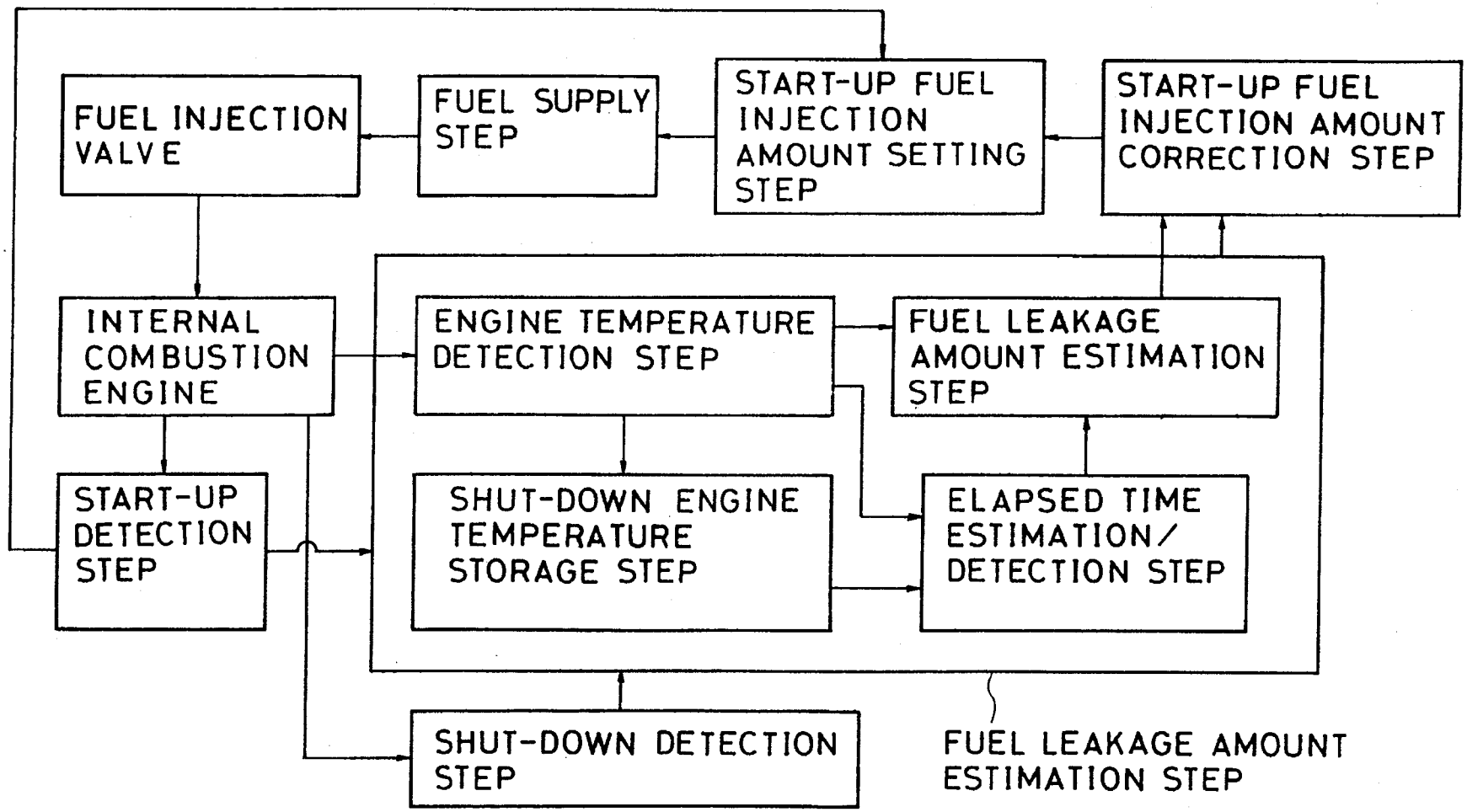
FIG. 1 is a block diagram illustrating a basic structure of fuel correction according to the present invention.
Figure 2:
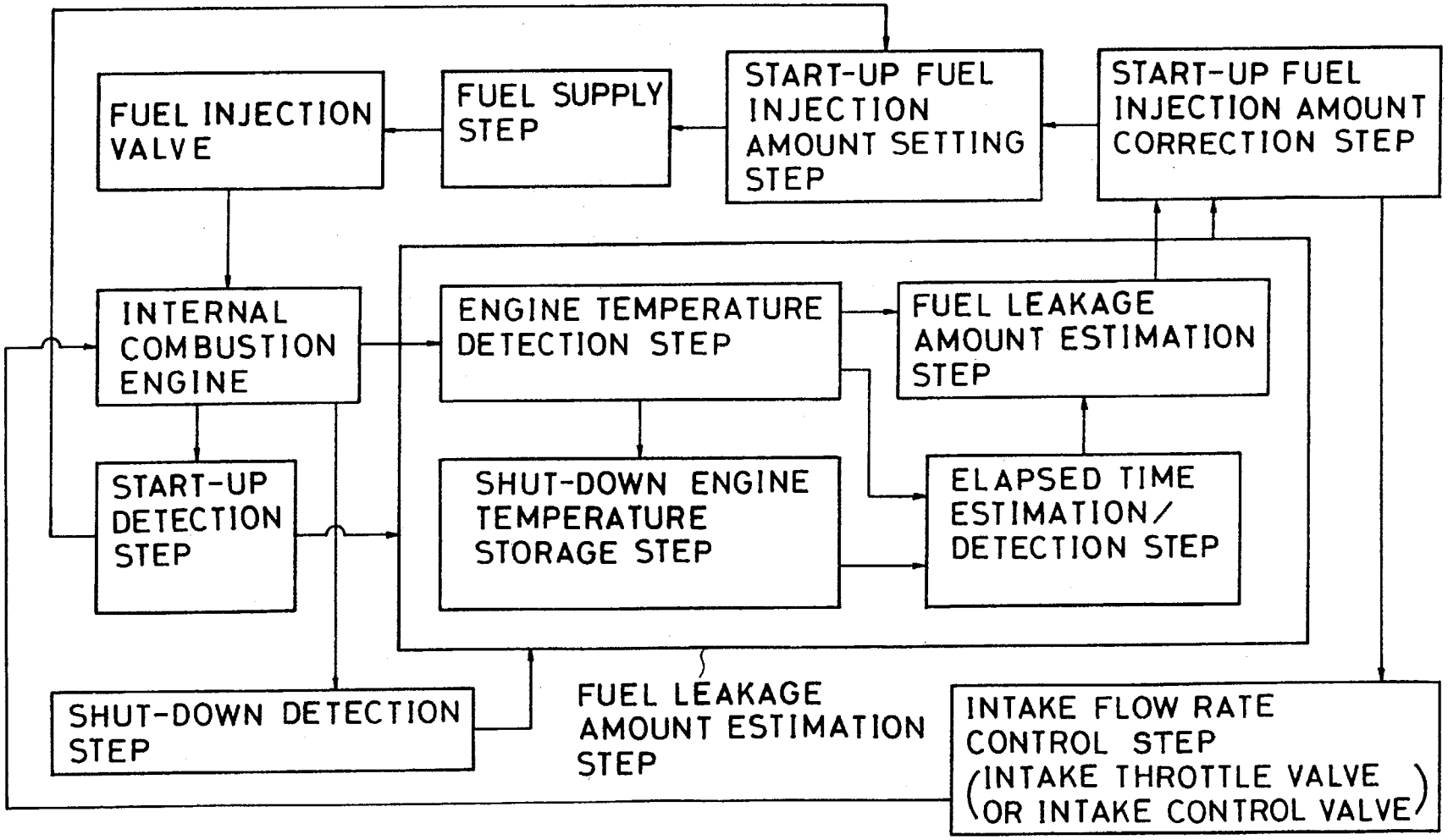
FIG. 2 is a block diagram illustrating a basic structure of intake flow rate correction according to the present invention.
Figure 3:
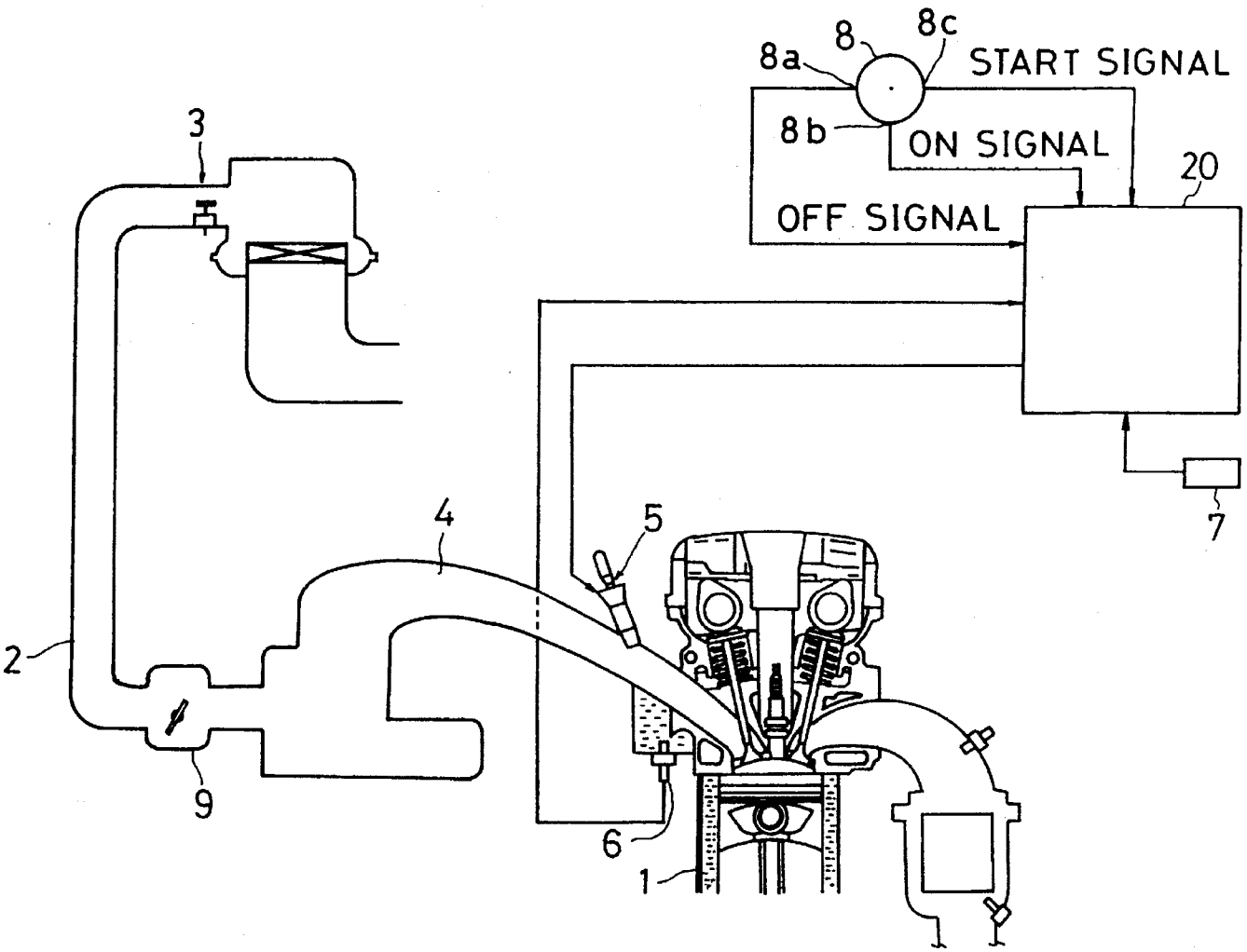
FIG. 3 is a schematic diagram illustrating an overall construction of an apparatus for control of the start-up air/fuel ratio of an internal combustion engine according to a first embodiment of the present invention.

In FIG. 3 which shows the construction of a first embodiment, an intake flow path 2 of an engine 1 is provided with an air flow meter 3 for detecting the intake flow rate, and a control valve 9 connected to an accelerator pedal, for controlling the intake flow rate. Solenoid type fuel injection valves 5 (only one shown in FIG. 1) for injection supply of fuel to each cylinder are provided in the downstream intake manifold 4.

The fuel injection valves 5 are driven open by an injection pulse signal from a control unit 20 incorporating a microcomputer, to thereby inject fuel.

Pre-stored in the control unit 20, as with the conventional example, is a start-up basic fuel injection pulse width CSP1LNTWK set to correspond to the engine temperature, a rotational speed correction coefficient KLN set to correspond to the cranking rotational speed, and a time correction coefficient KLT set to correspond to the cranking timing. The control unit 20 thus functions as a start-up fuel injection amount setting device, and a fuel supply device.

A water temperature sensor 6 is provided in the cooling jacket of the engine 1 for detecting the cooling water temperature Tw. There are no particular limitations concerning this device provided it can detect the engine temperature, or more preferably directly detect the temperature of the fuel injection valve, and the temperature near the intake port. With the present embodiment, the water temperature sensor 6 is used as the engine temperature detection device.

A crank angle sensor 7 is provided inside a distributor (not shown in FIG. 3), The engine rotational speed N is detected by counting in a fixed period the number of crank unit angle signals synchronized with the engine rotation and output from the crank angle sensor 7, or by measuring the period of a crank angle reference signal.

A key switch 8 is also provided. Respective output signals output from to an OFF position 8*a*, ON position 8*b* and start position 8*c* of the key switch 8 are input to the control unit 20.

The control unit 20 detects shut-down of the engine, from the engine operating conditions. That is to say, it detects movement of the key switch 8 from the ON position 8a to the OFF position 8*b*, or detects that the engine rotational speed has dropped to zero, by means of the crank angle sensor 7. Engine shut-down detection methods may involve other methods provided that they are able to detect that the engine has stopped.

The control unit 20 detects the engine start-up condition by detecting movement of the key switch 8 from the OFF position 8*b* to the 0N position 8*a*.

With this embodiment, the key switch 8 is used as a start-up detection device, and as a shut-down detection device.

The control unit 20 can store the cooling water temperature Twstop at engine shut-down in its memory even after switching off the key switch. It can also detect the cooling water temperature Twstart at the time of detecting the engine start-up conditions. This construction corresponds to the shut-down engine temperature storage device.

As follows is a description of a method for estimating a fuel leakage amount Δq for the leakage from the fuel injection valve 5 during the period from engine shut-down until restart.

Figure 7:
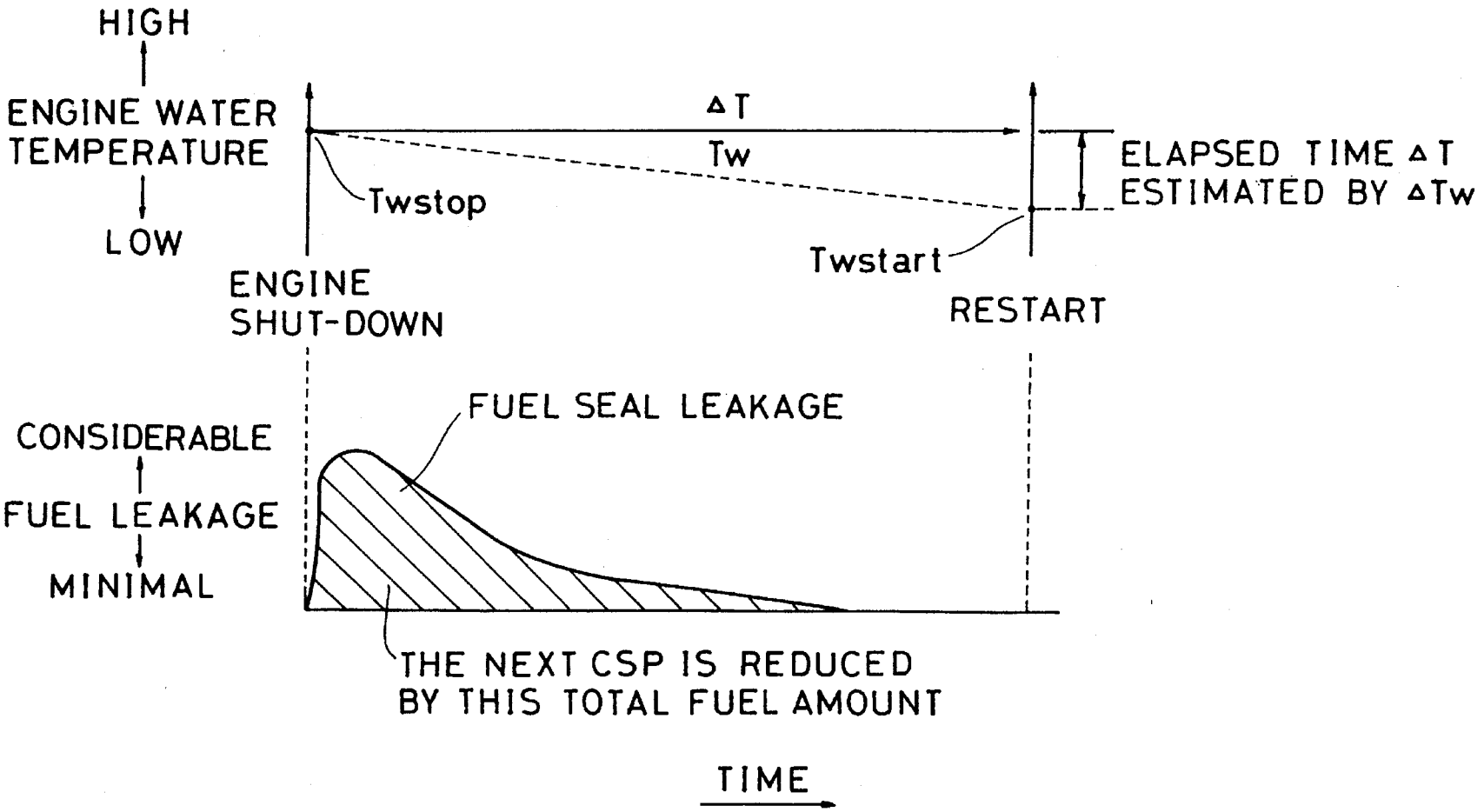
FIG. 7 is a graph showing the variation of engine temperature and fuel leakage amount with time after engine shut-down.
Figure 8:
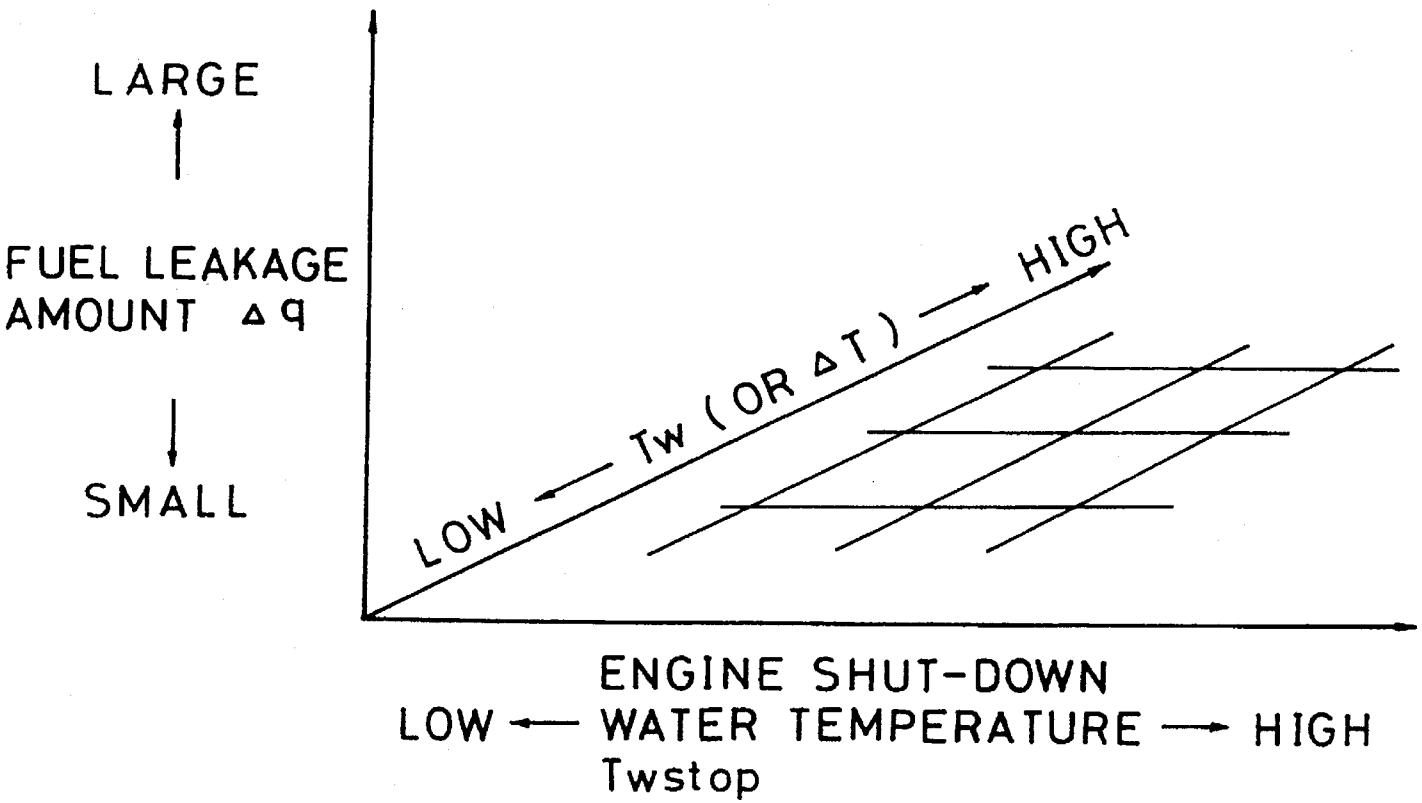
FIG. 8 shows a map for estimating fuel leakage amount.
Figure 9:
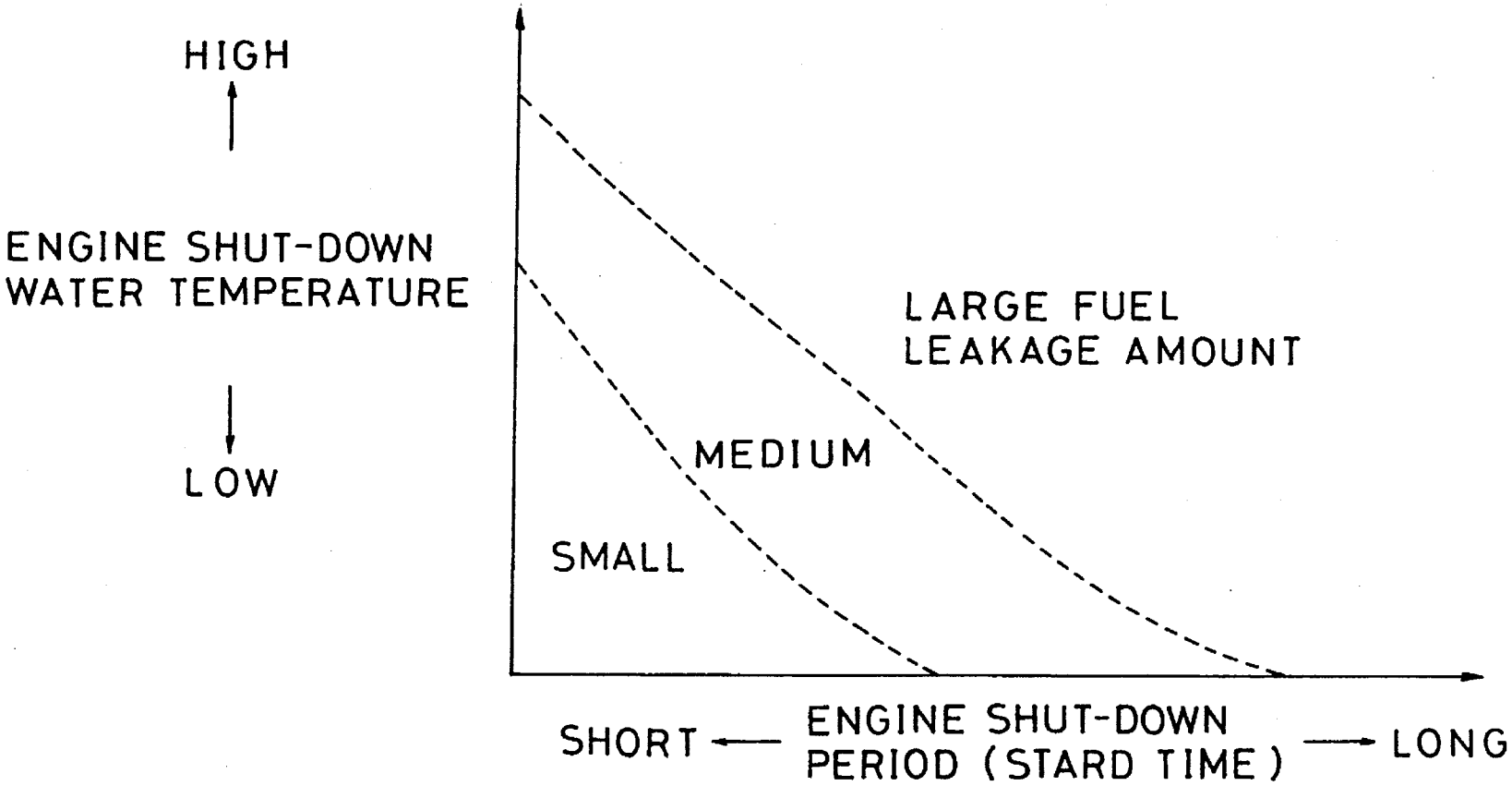
FIG. 9 is a graph showing a relationship between engine temperature, engine shut-down period (stand time), and fuel leakage amount.
Figure 10:
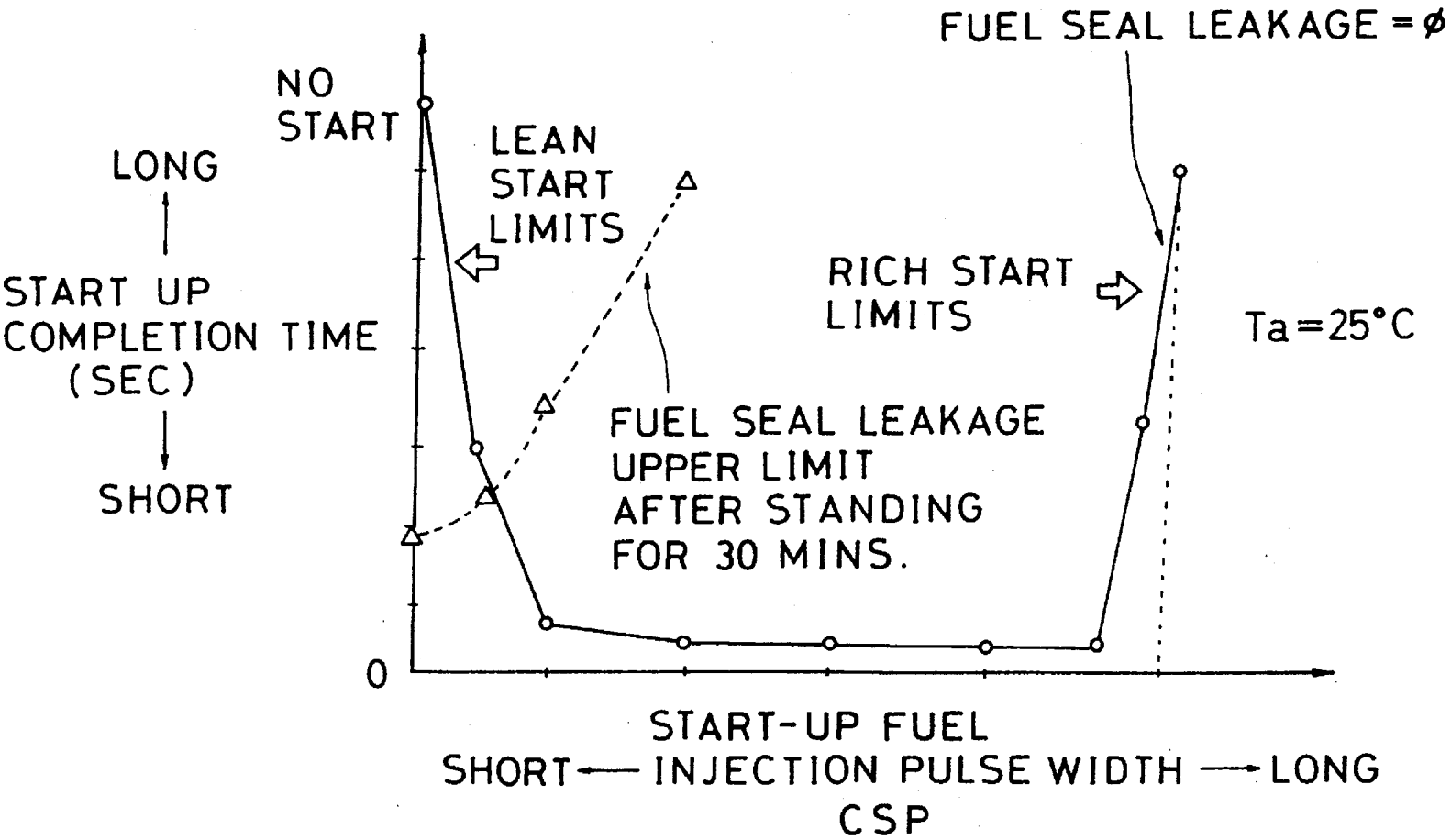
FIG. 10 shows an experimental result showing the influence of fuel leakage characteristics on the relationship between start-up injection pulse width CSP1LN, and start-up completion time.

The fuel leakage amount Δq for the leakage from the fuel injection valve 5 is estimated by obtaining a difference ΔTw between the shut-down cooling water temperature Twstop and the start-up cooling water temperature Twstart (i.e. ΔTw=Twstop–Twstart), and then estimating a time ΔT from engine shut-down until the next start-up. That is to say, as shown in FIG. 7, the fuel leakage amount Δq is determined by the shut-down cooling water temperature Twstop, and the time that the engine is stopped. Therefore, by obtaining the fuel leakage amount Δq experimentally beforehand for various temperature conditions, a fuel leakage amount estimation map as shown in FIG. 8 can be constructed. The fuel leakage amount Δq can then be estimated on the basis of the engine shut-down cooling water temperature Twstop and the before-mentioned difference ΔTw or time ΔT. Here the estimation of the time ΔT from engine shut-down until the next start-up by obtaining the difference ΔTw between the shut-down cooling water temperature Twstop and the start-up cooling water temperature Twstart (i.e. ΔTw=Twstop–Twstart), corresponds to the elapsed time estimation/detection device.

Figure 5:
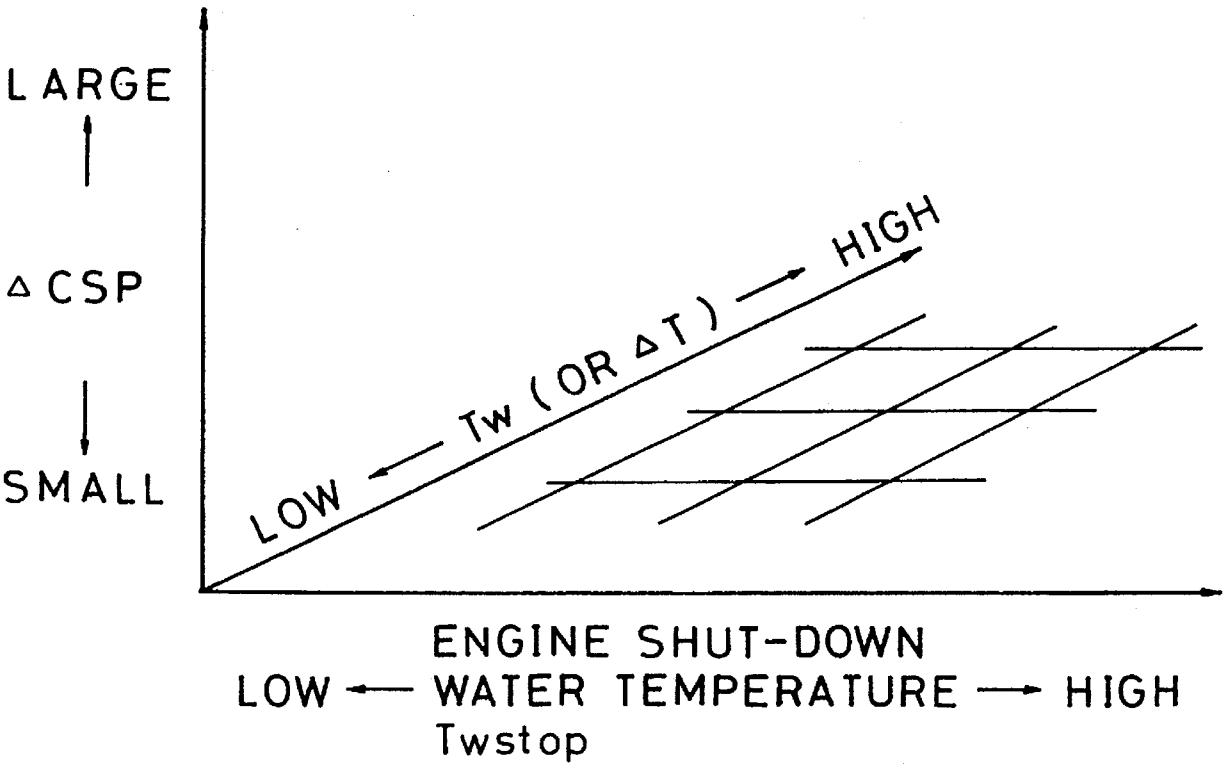
FIG. 5 shows a map for estimating a start-up fuel injection amount correction pulse width of the first embodiment.

The map for estimating the start-up fuel injection amount correction pulse width shown in FIG. 5 is provided in the control unit 20. Hence a start-up fuel injection amount correction pulse width ΔCSP corresponding to the fuel leakage amount Δq can be retrieved directly from this, thus simplifying the construction.

Here the before-mentioned fuel leakage amount estimation map or the map for estimating the start-up fuel injection amount correction pulse width make up the fuel leakage amount estimation device.

In the case of an extended shut-down period wherein the start-up cooling water temperature Twstart becomes equal to the ambient temperature, it is no longer possible to accurately estimate the shut-down period. However, as shown in FIG. 7, after a certain elapsed time, there is practically no change in the fuel leakage amount, so that prediction of the total fuel leakage amount from engine shut-down until restart is still possible. Of course, in order to accurately determine the elapsed time, the control unit 20 may comprise a timer, thus constituting an elapsed time estimation/detection device which directly measures the time. The fuel leakage amount estimation device however is not limited to the above device and may be a device that is able to directly detect the air/fuel ratio inside the intake manifold.

As follows, is a description based on the flow chart of FIG. 4, of a start-up fuel injection amount correction control of the present invention which is carried out by the control unit 20.

In step 1 (denoted by S1 in the figure with subsequent steps indicated in a similar manner), it is judged if the engine start-up condition has occurred. If so, control proceeds to step 2, while if not, the flow is terminated.

In step 2, the engine start-up cooling water temperature Twstart is obtained from the signal from the water temperature sensor 6.

In step 3, the temperature difference ΔTw between the start-up cooling water temperature Twstart and previous engine shut-down cooling water temperature Twstop stored in the control unit 20 (i.e. ΔTw=Twstop–Twstart), or the time ΔT from engine shut-down until restart, is obtained.

In step 4, the start-up correction injection pulse width ΔCSP corresponding to a fuel leakage amount Δq of the leakage from the fuel injection valve 5 into the intake system from shut-down until restart is retrieved by referring to the map of FIG. 5, on the basis of the previous engine shut-down cooling water temperature Twstop and the temperature difference ΔTw, or the time ΔT from engine shut-down until restart.

Figure 6:
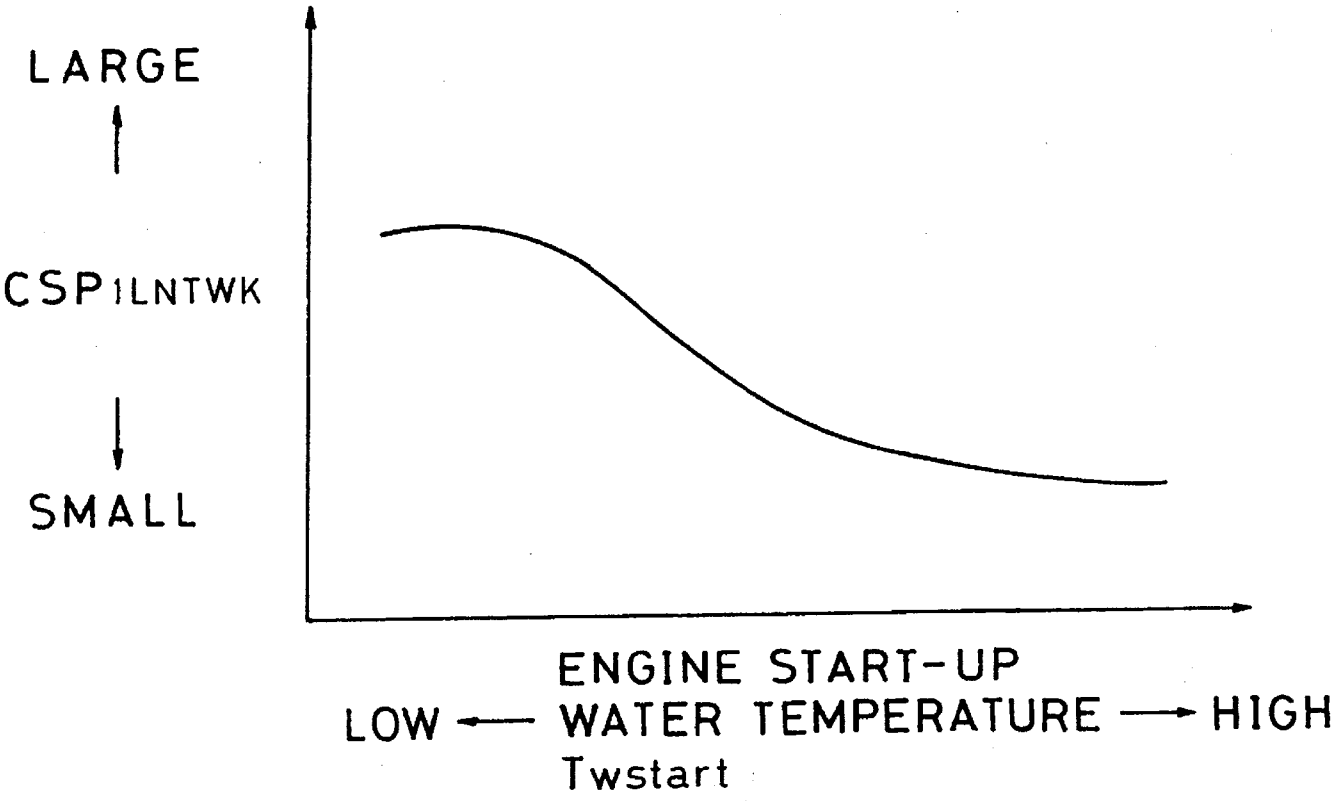
FIG. 6 is a graph of start-up basic fuel injection pulse width CSP1LNTWK set corresponding to engine start-up cooling water temperature Twstart, for the first embodiment.

In step 5, the start-up basic fuel injection pulse width CSP1LNTWK set to correspond to the start-up cooling water temperature Twstart, is obtained by retrieval with reference to the graph of FIG. 6.

In step 6, the value CSP1LNTWK' is obtained by subtracting the start-up correction injection pulse width ΔCSP from the start-up basic fuel injection pulse width CSP1LNTWK (i.e. CSP1LNTWK'=CSP1LNTWK–ΔCSP). Here step 6 makes up the start-up fuel injection amount correction device.

In step 7, as with the conventional example, CSP1LNTWK' is multiplied by the rotational speed correction coefficient KLN and the time correction coefficient KLT to finally obtain the start-up fuel injection pulse width CSP1LN.

In step 8, this result is output to the fuel injection valve 5.

With this embodiment, the fuel leakage amount Δq for the leakage from the fuel injection valve 5 during the time from engine shut-down until the next engine start-up is estimated by obtaining the temperature difference ΔTw between the start-up cooling water temperature Twstart and the previous engine shut-down cooling water temperature Twstop (i.e. ΔTw= Twstop–Twstart), and then estimating the time ΔT from engine shut-down until restart. Then, the start up fuel injection amount, increase corrected by the conventional method, can be reduction corrected by subtracting the fuel leakage amount Δq from the normal start up fuel injection amount, to thereby maintain the mixture at an air/fuel ratio suitable for starting at restart.

As follows is a description of a second embodiment.

Figure 11:
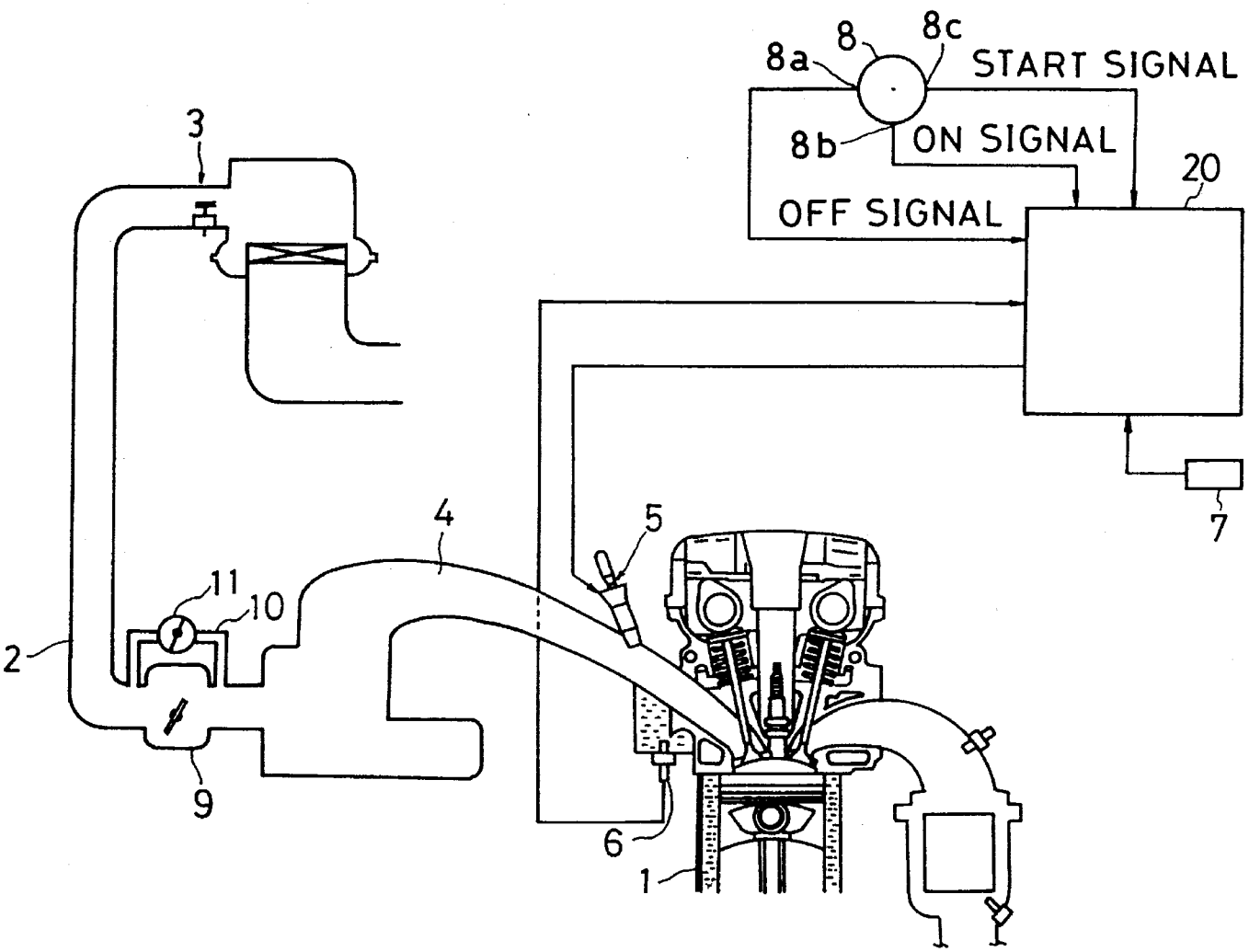
FIG. 11 is a schematic diagram illustrating an overall construction of an apparatus for control of the start-up air/fuel ratio of an internal combustion engine according to second and third embodiment of the present invention.

The second embodiment as shown in FIG. 11, includes in addition to the construction of the first embodiment, an intake by-pass passage 10 which branches from the intake passage 2, and then recombines so as to by-pass the intake throttle valve 9 provided in the intake passage 2. An intake control valve 11 for controlling the intake flow rate passing through the intake by-pass passage 10 is provided intermediate along the intake by-pass passage 10. The opening of the intake control valve 11 is controlled by a pulse width ISCD of the drive pulse signal from the control unit 20 which incorporates the micro-computer. The intake by-pass passage 10, and intake control valve 11 can be substituted by an idle speed control device (ISCD). When the intake by-pass passage 10 and the intake control valve 11 are not provided, control of the opening of the intake throttle valve 9 can be forcibly increased by means of an actuator etc. The above intake throttle valve 9 or the intake control valve 11 correspond to the intake flow rate control device.

With the second embodiment having such a construction, in contrast to the first embodiment wherein only the start-up fuel injection amount is reduction corrected by the fuel leakage amount Δq, the intake flow rate also can be increased to prevent an over rich condition. The arrangement thus takes into account cases such as when over richness cannot be avoided by simply reducing the fuel injection amount. For example in the case of considerable fuel leakage, or when the leaking fuel is easily vaporized, and the over richness cannot be avoided even by shutting off start-up fuel injection from the fuel injection valve 5. (The arrangement covers cases such as shown by the broken line in FIG. 10, for the case of fuel seal leakage, when even with the start-up fuel injection pulse width (fuel injection amount) at zero, the air/fuel ratio is excessively rich so that it takes several seconds to complete starting).

Figure 13:
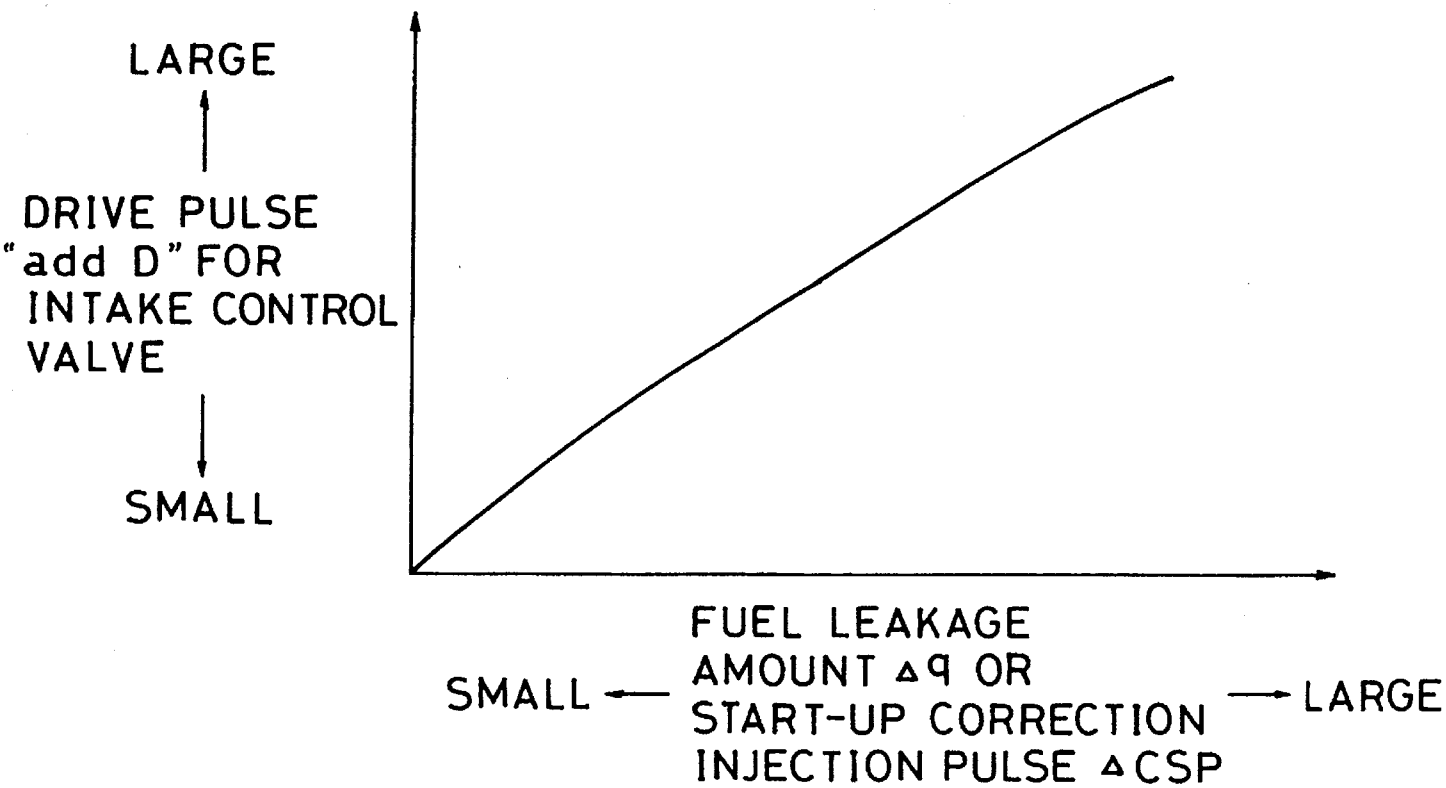
FIG. 13 shows a map for retrieving a start-up intake control valve drive pulse width for the second embodiment.

Therefore, in addition to the case for the first embodiment, a start-up intake control valve drive control map as shown in FIG. 13 from which a start-up drive pulse width "add D" for the intake control valve 11 can be retrieved on the basis of the start-up correction injection pulse width ΔCSP corresponding to the fuel leakage amount Δq, is stored in the control unit 20.

Figure 12:
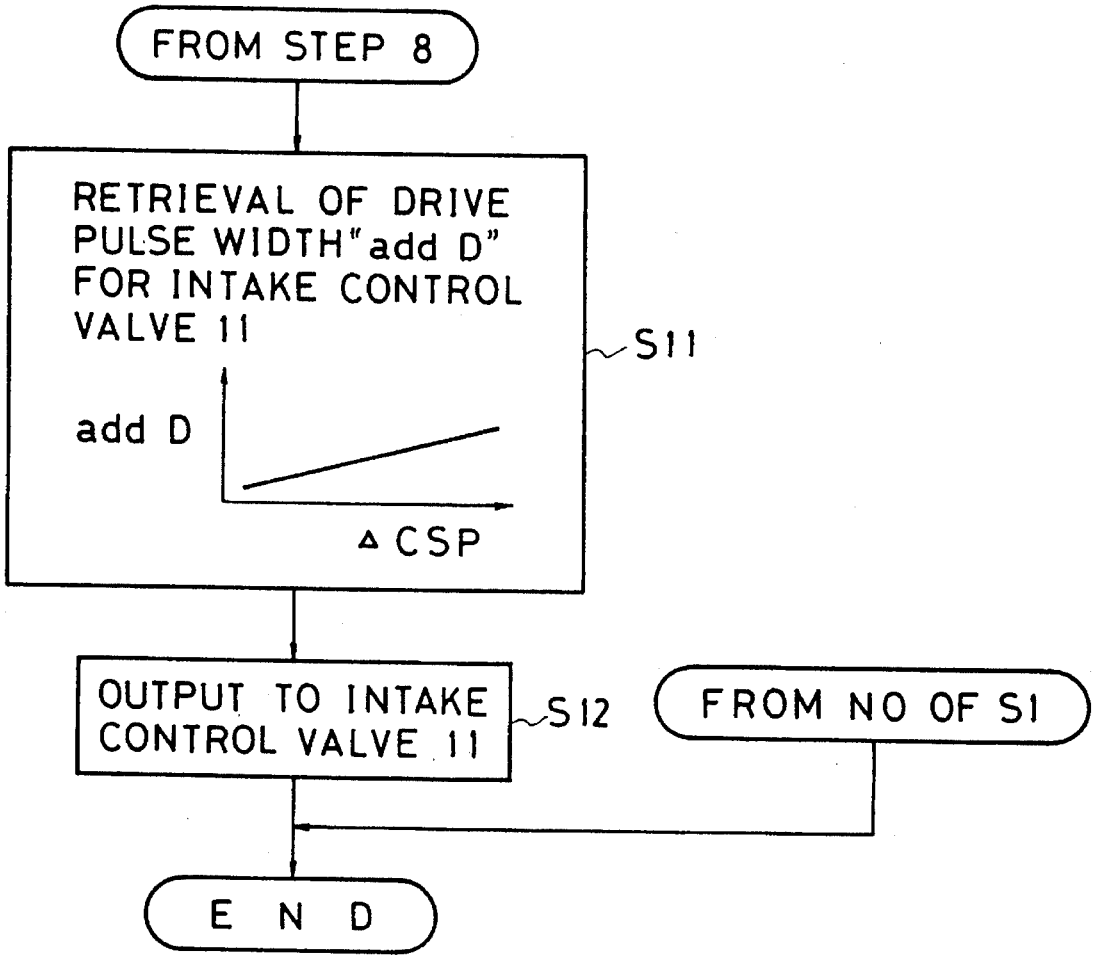
FIG. 12 is a flow chart for illustrating a start-up drive control for an intake control valve of the second embodiment.

Next is a description based on the flow chart of FIG. 12, of the start-up drive control of the intake control valve 11 of the second embodiment, which is carried out by the control unit 20.

Figure 4:
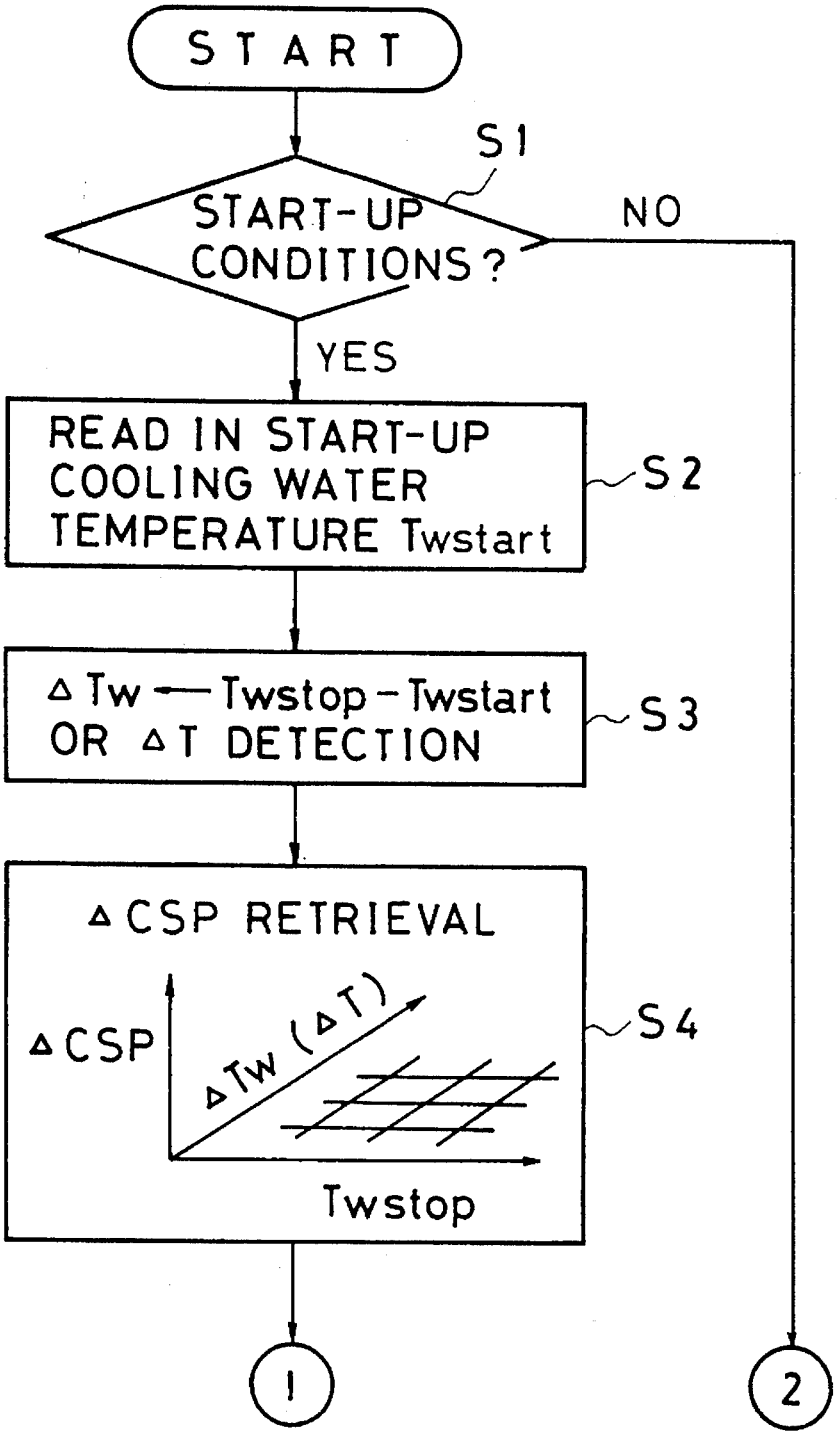
FIGS. 4(A) and 4(B) are flowcharts for illustrating a start-up fuel injection amount correction control of the first embodiment.
Figure 4:
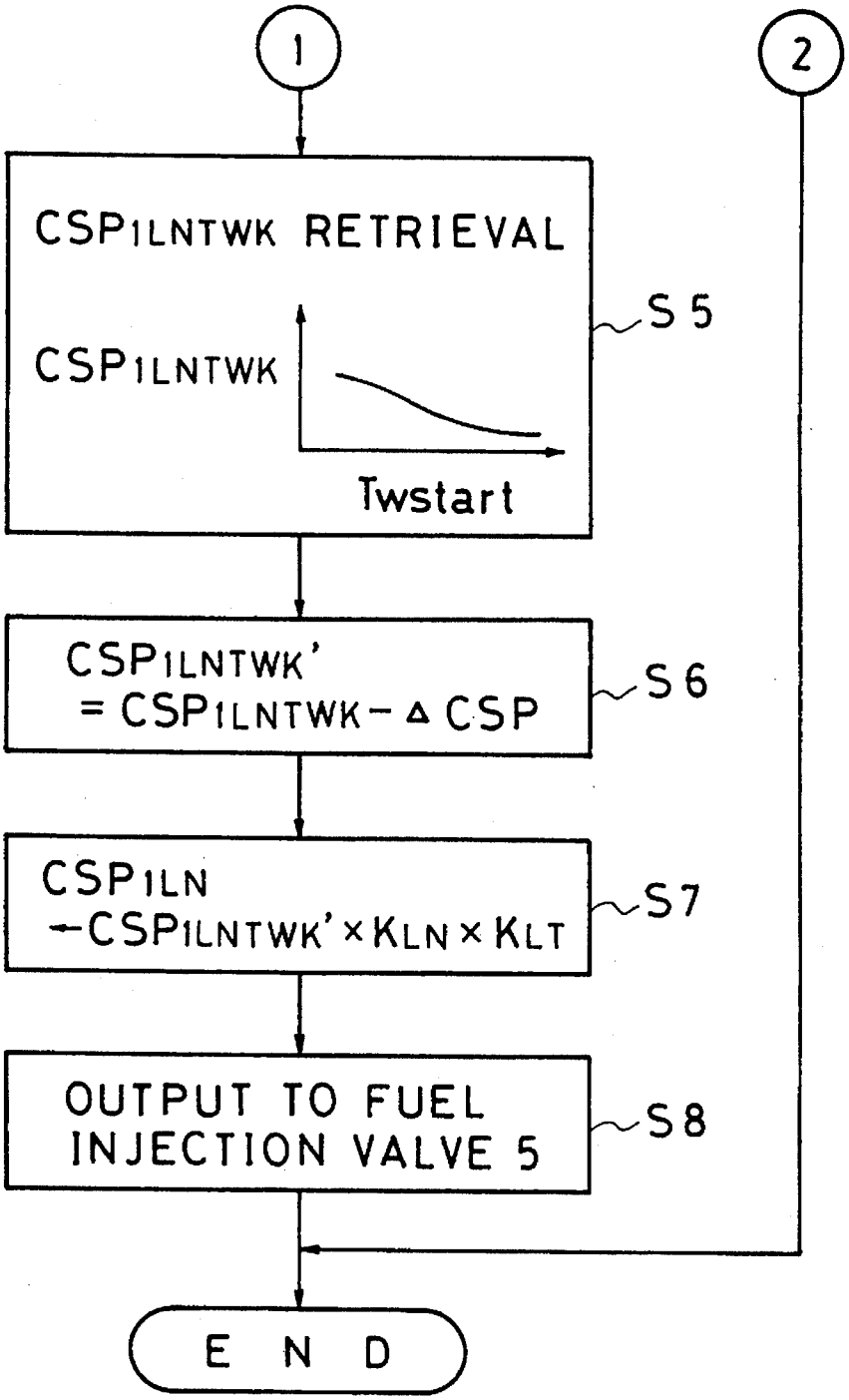

The flow chart is inserted after step 8 in the flow chart of the first embodiment shown in FIG. 4.

In step 11, the drive pulse width "add D" for the intake control valve 11 is retrieved by referring to the map of FIG. 13, on the basis of the start-up correction injection pulse width ΔCSP obtained in the before-mentioned step 4.

In step 12, the drive pulse width "add D" signal is sent to the intake control valve 11, and drive control of the intake control valve 11 is carried out based on this to increase the intake flow rate. Here, steps 11 and 12 make up the start-up intake flow rate correction device.

With this embodiment, as with the first embodiment, the fuel leakage amount Δq for the leakage from the fuel injection valve 5 during the time from engine shut-down until the next engine start-up is estimated by obtaining the temperature difference ΔTw between the start-up cooling water temperature Twstart and previous engine the shut-down cooling water temperature Twstop (i.e. ΔTw=Twstop–Twstart), and then estimating the time ΔT from engine shut-down until restart. In the case of an over rich condition even with subtraction of the fuel leakage amount Δq from the normal start up fuel injection amount, this over rich condition can be prevented by an increase in the intake flow rate, so that at restart the mixture can be corrected to an air/fuel ratio suitable for starting.

As follows is a description of a third embodiment.

Figure 14:
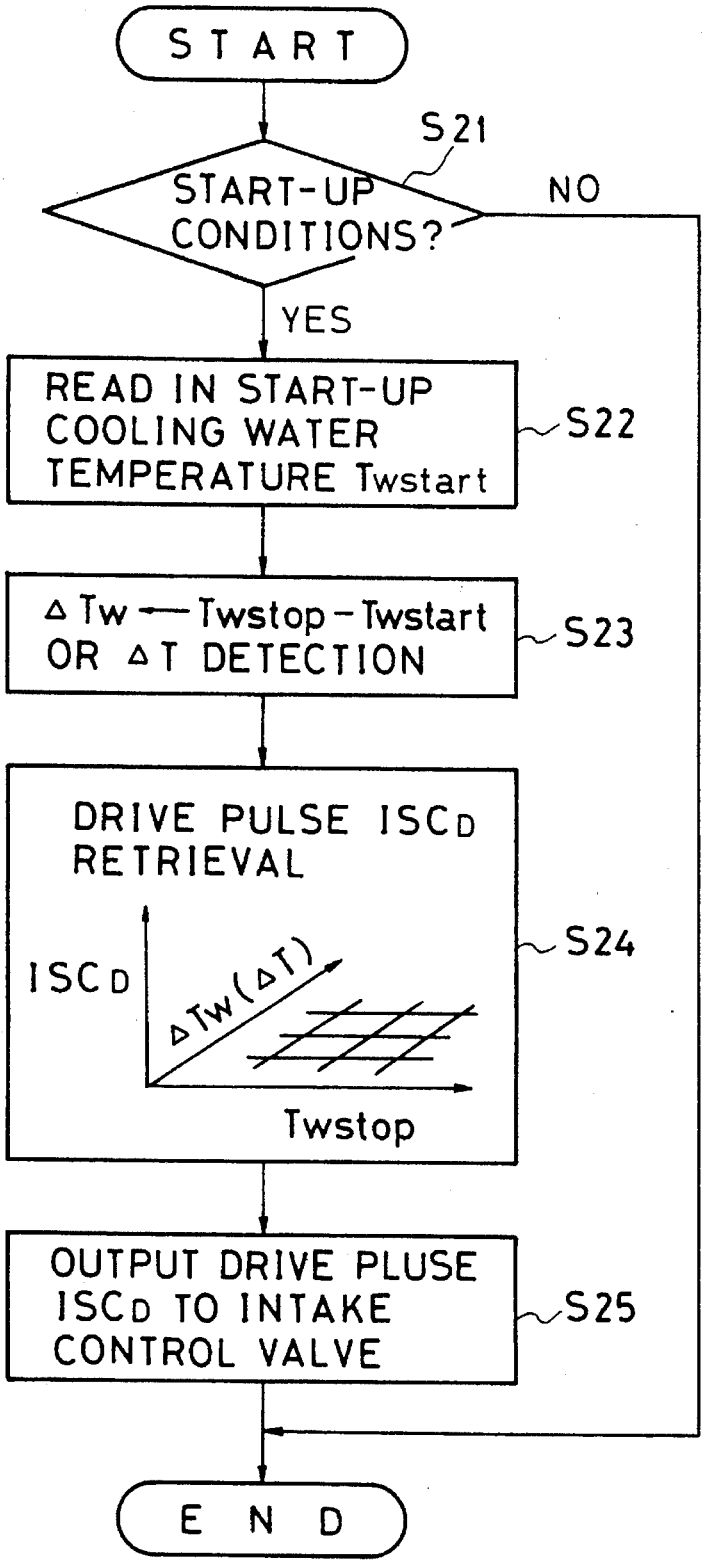
FIG. 14 is a flow chart for illustrating a start-up drive control for an intake control valve of the third embodiment.
Figure 15:
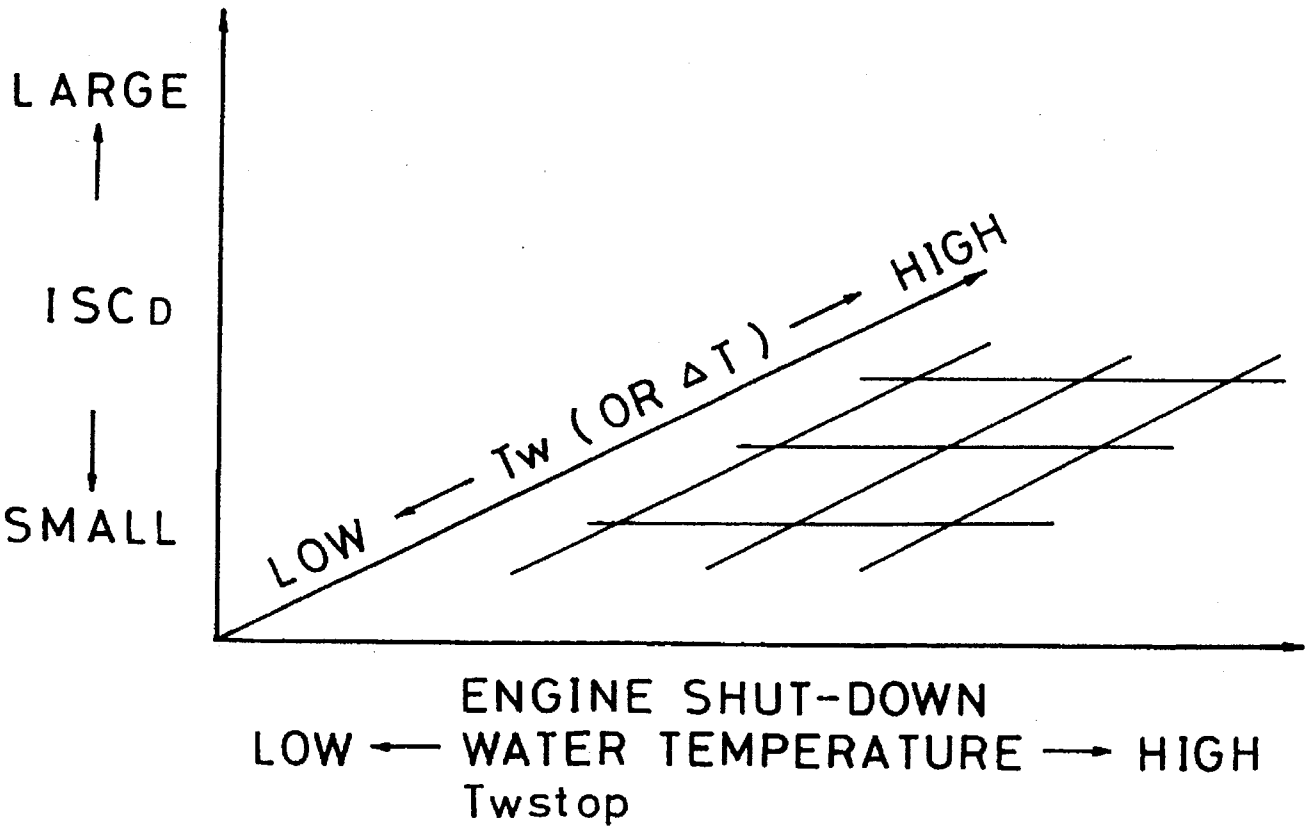
FIG. 15 shows a map for estimating the start-up intake control valve drive pulse width for the third embodiment.

The third embodiment is constructed in a similar manner to the second embodiment shown in FIG. 11. Step 4 through step 8 of the flow chart of the first embodiment shown in FIG. 4 are replaced by step 24 and step 25 shown in FIG. 14 for the case where the intake flow rate at start-up is increased to maintain a predetermined air/fuel ratio. Step 21 through step 23 shown in FIG. 14 are the same as step 1 through step 3 of the flow chart shown in FIG. 4.

That is to say, in step 24, as with the first embodiment, the fuel leakage amount Δq for the leakage from the fuel injection valve 5 into the intake system, from engine shut-down until restart, is estimated on the basis of the previous shut-down cooling water temperature Twstop and the difference ΔTw (or the time ΔT from engine shut-down until restart), and a drive pulse width ISCD for the intake control valve 11 corresponding to the intake flow rate necessary for combustion of the fuel leakage amount Δq, is retrieved by referring to the map of FIG. 5 previously stored in the control unit 20.

Then in step 25, the drive pulse width ISCD is output to the intake control valve 11. Steps 24 and 25 make up the start-up intake flow rate correction device.

With this embodiment, in the case of fuel leaking from the fuel injection valve 5 the fuel amount supplied to the engine is not reduction corrected, the desirable air/fuel ratio being obtained solely through an increase in the intake flow rate. Thus, since the fuel leakage amount is added to the normal start-up increase amount, the fuel amount supplied to the engine is larger compared to that for normal start-up. However for vehicles etc. with normal manual transmission, the arrangement is effective in providing a simple device for starting improvement.

Of course, with the second and third embodiments, when the intake by-pass passage 10 and intake control valve 11 are used as an idle speed control device (ISCD), then naturally the drive pulse width "add D", or the drive pulse width ISCD can be added to the basic drive pulse width for the intake control valve 11 set to meet the drive load of the auxiliary equipment/accessories etc. at start-up.

I claim:

1. A method for controlling a start-up air/fuel ratio of an internal combustion engine, comprising:

detecting an engine start-up;

setting a start-up fuel injection amount of a fuel injection valve installed in an engine intake system;

supplying fuel to said engine from said fuel injection valve in an amount set by said start-up fuel injection amount setting step;

detecting shut-down of the engine;

estimating an amount of fuel leaked from said fuel injection valve into the engine intake system during the period from engine shut-down until restart;

correcting, on the basis of the leakage amount estimated by said fuel leakage amount estimating step, the start-up fuel injection amount set by said start-up fuel injection amount setting step; and supplying fuel to said engine from said fuel injection valve in an amount corrected by said correcting step.

2. A method for controlling a start-up air/fuel ratio of an internal combustion engine as claimed in claim 1, wherein said fuel leakage amount estimation step comprises:

detecting a temperature of the engine;

storing/retaining the engine temperature at engine shut-down;

estimating or detecting an elapsed time from engine shut-down until restart; and estimating the amount of fuel leaked from the fuel injection valve into the intake system during the period from shut-down until restart, on the basis of an engine temperature at the previous shut-down, and an elapsed time from the previous shut-down until restart.

3. A method for controlling a start-up air/fuel ratio of an internal combustion engine as claimed in claim 2, wherein said elapsed time estimation/detection step detects the elapsed time from the previous shut-down until restart, using a timer which is started by an OFF signal and stopped by an ON signal of a key switch.

4. A method for controlling a start-up air/fuel ratio of an internal combustion engine as claimed in claim 2, wherein said elapsed time estimation/detection step estimates the elapsed time from the previous shut-down until restart, on the basis of the engine shut-down temperature and temperature at restart, detected by said engine temperature detection step.

5. A method for controlling a start-up air/fuel ratio of an internal combustion engine comprising:

detecting an engine start-up;

setting a start-up fuel injection amount of a fuel injection valve installed in an engine intake system;

supplying fuel to the engine from said fuel injection valve in an amount set by said start-up fuel injection amount setting step;

detecting shut-down of the engine;

estimating an amount of fuel leaked from said fuel injection valve into the intake system of the engine during the period from engine shut-down until restart;

correcting, on the basis of the leakage amount estimated by said fuel leakage amount estimation step, a start-up intake flow rate; and supplying intake air, using an intake flow rate control means provided in the intake system of the engine, to the engine at a flow rate corrected by said correcting step.

6. A method for controlling a start-up air/fuel ratio of an internal combustion engine as claimed in claim 5, wherein said fuel leakage amount estimation step comprises:

detecting a temperature of the engine;

storing/retaining the engine temperature at engine shut-down;

estimating or detecting an elapsed time from engine shut-down until restart; and estimating the amount of fuel leaked from the fuel injection valve into the intake system during the period from shut-down until restart, on the basis of an engine temperature at the previous shut-down, and an elapsed time from the previous shut-down until restart.

7. A method for controlling a start-up air/fuel ratio of an internal combustion engine as claimed in claim 6, wherein said elapsed time estimation/detection step detects the elapsed time from the previous shut-down until restart, using a timer which is started by an OFF signal and stopped by an ON signal of a key switch.

8. A method for controlling a start-up air/fuel ratio of an internal combustion engine as claimed in claim 6, wherein said elapsed time estimation/detection step estimates the elapsed time from the previous shut-down until restart, on the basis of the engine shut-down temperature and temperature at restart, detected by said engine temperature detection step.

9. A method for controlling a start-up air/fuel ratio of an internal combustion engine as claimed in claim 5, wherein said start-up intake flow rate correction step corrects the start-up intake flow rate by adjustment of the opening of an intake throttle valve connected to an accelerator pedal and acting as an intake flow rate control means.

10. A method for controlling a start-up air/fuel ratio of an internal combustion engine as claimed in claim 5, wherein said start-up intake flow rate correction step corrects the start-up intake flow rate by adjustment of an opening of an intake control valve, which is interposed in an intake by-pass passage which by-passes said intake throttle valve, and which acts as an intake flow rate control means.

11. A method for controlling a start-up air/fuel ratio of an internal combustion engine comprising:

detecting an engine start-up;

setting a start-up fuel injection amount of a fuel injection valve installed in an engine intake system;

supplying fuel to the engine from said fuel injection valve in an amount set by said start-up fuel injection amount setting step;

detecting shut-down of the engine;

estimating an amount of fuel leaked from said fuel injection valve into the intake system of the engine during the period from engine shut-down until restart;

correcting, on the basis of the leakage amount estimated by said fuel leakage amount estimation step, the start-up fuel injection amount set by said start-up fuel injection amount setting step;

supplying fuel to the engine from said fuel injection valve in an amount corrected by said correcting step;

correcting, on the basis of the leakage amount estimated by said fuel leakage amount estimation step, a start-up intake flow rate; and Supplying intake air, using an intake flow rate control means provided in the intake system of the engine, to the engine at a flow rate corrected by said second recited correcting stem.

12. An apparatus for controlling a start-up air/fuel ratio of an internal combustion engine comprising:

start-up detection means for detecting engine start-up;

start-up fuel injection amount setting means for setting a start-up fuel injection amount of a fuel injection valve installed in an engine intake system;

fuel supply means for supplying fuel from said fuel injection valve in an amount set by said start-up fuel injection amount setting means;

shut down detection means for detecting shut-down of the engine;

fuel leakage amount estimation means for estimating an amount of fuel leaked from said fuel injection valve into the intake system of the engine during the period from engine shut-down until restart; and start-up fuel injection amount correction means for correcting, on the basis of the leakage amount estimated by said fuel leakage amount estimation means, the start-up fuel injection amount set by said start-up fuel injection amount setting means.

13. An apparatus for controlling a start-up air/fuel ratio of an internal combustion engine as claimed in claim 12, wherein said fuel leakage amount estimation means comprises:

engine temperature detection means for detecting a temperature of the engine;

shut-down engine temperature storage means for storing/retaining the engine temperature at engine shut-down; and elapsed time estimation/detection means for estimating or detecting an elapsed time from engine shut-down until restart; and wherein the amount of the fuel leaked from the fuel injection valve into the intake system during the period from shut-down until restart is estimated on the basis of an engine temperature at the previous shut-down, and an elapsed time from the previous shut-down until restart.

14. An apparatus for controlling a start-up air/fuel ratio of an internal combustion engine as claimed in claim 13, wherein said elapsed time estimation/detection means detects the elapsed time from the previous shut-down until restart, using a timer which is started by an OFF signal and stopped by an ON signal of a key switch.

15. An apparatus for controlling a start-up air/fuel ratio of an internal combustion engine as claimed in claim 13, wherein said elapsed time estimation/detection means estimates the elapsed time from the previous shut-down until restart, on the basis of the engine shut-down temperature and temperature at restart, detected by said engine temperature detection means.

16. An apparatus for controlling a start-up air/fuel ratio of an internal combustion engine comprising:

start-up detection means for detecting engine start-up;

start-up fuel injection amount setting means for setting a start-up fuel injection amount of a fuel injection valve installed in an engine intake system;

fuel supply means for supplying fuel from said fuel injection valve in an amount set by said start-up fuel injection amount setting means;

shut down detection means for detecting shut-down of the engine;

fuel leakage amount estimation means for estimating an amount of fuel leaked from said fuel injection valve into an intake system of the engine during the period from engine shut-down until restart; and start-up intake flow rate correction means for correcting, on the basis of the leakage amount estimated by said fuel leakage amount estimation means, a start-up intake flow rate, using an intake flow rate control means provided in an intake system of the engine.

17. An apparatus for controlling a start-up air/fuel ratio of an internal combustion engine as claimed in claim 16, wherein said fuel leakage amount estimation means comprises:

engine temperature detection means for detecting a temperature of the engine;

shut-down engine temperature storage means for storing/retaining the engine temperature at engine shut-down; and elapsed time estimation/detection means for estimating or detecting an elapsed time from engine shut-down until restart; and wherein the amount of fuel leaked from the fuel injection valve into the intake system during the period from shut-down until restart is estimated on the basis of an engine temperature at the previous shut-down, and an elapsed time from the previous shut-down until restart.

18. An apparatus for controlling a start-up air/fuel ratio of an internal combustion engine as claimed in claim 17, wherein said elapsed time estimation/detection means detects the elapsed time from the previous shut-down until restart, using a timer which is started by an OFF signal and stopped by an ON signal of a key switch.

19. An apparatus for controlling a start-up air/fuel ratio of an internal combustion engine as claimed in claim 17, wherein said elapsed time estimation/detection means estimates the elapsed time from the previous shut-down until restart, on the basis of the engine shut-down temperature and temperature at restart, detected by said engine temperature detection means.

20. An apparatus for controlling a start-up air/fuel ratio of an internal combustion engine as claimed in claim 16, wherein said start-up intake flow rate correction means corrects the start-up intake flow rate by adjustment of the opening of an intake throttle valve connected to an accelerator pedal and acting as an intake flow rate control means.

21. An apparatus for controlling a start-up air/fuel ratio of an internal combustion engine as claimed in claim 16, wherein said start-up intake flow rate correction means corrects the start-up intake flow rate by adjustment of an opening of an intake control valve, which is interposed in an intake by-pass passage which by-passes said intake throttle valve, and which acts as an intake flow rate control means.

22. An apparatus for controlling a start-up air/fuel ratio of an internal combustion engine comprising:

start-up detection means for detecting engine start-up;

start-up fuel injection amount setting means for setting a start-up fuel injection amount of a fuel injection valve installed in an engine intake system;

fuel supply means for supplying fuel from said fuel injection valve in an amount set by said start-up fuel injection amount setting means;

shut down detection means for detecting shut-down of the engine;

fuel leakage amount estimation means for estimating an amount of fuel leaked from said fuel injection valve into the intake system of the engine during the period from engine shut-down until restart;

start-up fuel injection amount correction means for correcting, on the basis of the leakage amount estimated by said fuel leakage amount estimation means, the start-up fuel injection amount set by said start-up fuel injection amount setting means; and start-up intake flow rate correction means for correcting, on the basis of the leakage amount estimated by said fuel leakage amount estimation step, a start-up intake flow rate, using an intake flow rate control means provided in an intake system of the engine.

* * * * *